US005786832A

United States Patent [19]

Yamanaka et al.

[11] Patent Number: 5,786,832

[45] Date of Patent: Jul. 28, 1998

[54] INK-JET RECORDING HEAD

[75] Inventors: Akihiro Yamanaka; Takashi Watanabe, both of Yokohama; Hiroyuki Ishinaga, Tokyo; Takahisa Kawamura, Yokohama; Seiichiro Karita, Yokohama; Norio Ohkuma, Yokohama; Masahiko Higuma, Togane; Akira Goto, Yokohama; Teruo Arashima, Kawasaki; Motoaki Sato, Tokyo; Megumi Saito, Kawasaki, all of Japan

[73] Assignee: Canon Kabushiki Kaisha, Tokyo, Japan

[21] Appl. No.: 281,801

[22] Filed: Jul. 22, 1994

Related U.S. Application Data

[63] Continuation of Ser. No. 846,579, Mar. 5, 1992, abandoned.

[30] Foreign Application Priority Data

| | | | |
|---|---|---|---|
| Mar. 8, 1991 | [JP] | Japan | 3-043653 |
| Mar. 8, 1991 | [JP] | Japan | 3-043666 |
| Jul. 15, 1991 | [JP] | Japan | 3-173959 |
| Mar. 2, 1992 | [JP] | Japan | 3-044770 |

[51] Int. Cl.[6] ..... B41J 2/135; B41J 2/16

[52] U.S. Cl. ..... 347/45; 347/47

[58] Field of Search ..... 347/44, 45, 47; 219/121.6, 121.7, 212.71; 29/890.1; 264/22, 154; 156/643.1, 644.1

[56] References Cited

U.S. PATENT DOCUMENTS

| | | | |
|---|---|---|---|
| 4,368,476 | 1/1983 | Uehara et al. | 346/140 R |
| 4,524,104 | 6/1985 | Hagio et al. | 428/355 X |
| 5,059,973 | 10/1991 | Watanave | 346/1.1 |

FOREIGN PATENT DOCUMENTS

| | | |
|---|---|---|
| 0367541 | 5/1990 | European Pat. Off. . |
| 2527079 | 12/1976 | Germany . |
| 59-142157 | 8/1984 | Japan . |
| 61-125851 | 6/1986 | Japan . |

*Primary Examiner*—Joseph W. Hartary
*Assistant Examiner*—Juanita Stephens
*Attorney, Agent, or Firm*—Fitzpatrick, Cella, Harper & Scinto

[57] ABSTRACT

An ink-jet recording head has ejection outlets formed by treating a face of a plate for the ejection outlets with a water-repellent and irradiating the plate with a laser beam from the backside of the plate. The head is provided with a sealing member for sealing the ejection outlets. The water-repellent has a hardness of higher than the pencil hardness 6B at room temperature. A decomposition product layer is formed on the layer of the water repellent at peripheral portions of the ejection outlets.

4 Claims, 7 Drawing Sheets

INK-JET RECORDING HEAD

This application is a continuation, of application Ser. No. 07/846,579 filed Mar. 5, 1992, now abandoned.

BACKGROUND OF THE INVENTION

1. Field of the Invention

The present invention relates to a recording head, including a recording head unified with an ink tank, which is applicable to business machines such as printers, copying machines, ink-jet recording apparatuses, and so forth, particularly to a recording head which is detachable from the main body of a machine. The present invention also relates to a method of storing the recording head.

2. Related Background Art

In conventional ink-jet recording apparatuses, recording heads, and recording units having an integral recording head and ink tank, there are known those which eject fine liquid droplets by utilizing thermal energy, an electromechanical transducer or the combination thereof, and those which eject deflected liquid droplets by utilizing a pair of electrodes.

From among these recording heads, ink-jet recording heads which eject recording liquid by utilizing thermal energy are widely used practically. This is because the liquid-ejection outlets can readily be arranged in high density for formation of shooting recording-liquid droplets to give high resolution of recording, and also because the apparatus can be readily made compact advantageously. Such recording heads, however, are liable disadvantageously to cause leakage of ink during storage and transportation thereof.

To prevent the leakage of ink from the recording head, a seal tape is stuck onto the tip portion of the head (or ejection outlets) when shipping the recording heads.

However, increase of the adhesiveness of the seal tape to prevent surely the ink leakage gives rise to need for stronger force on the seal tape removal, which may disadvantageously cause accidental drop-off of the recording head or scattering of the ink from the recording head to soil the apparatus, or otherwise may cause deformation of the ejection outlet and result in poor recording.

Accordingly, the countermeasures as below are considered to avoid the above disadvantages even if the peeling force to remove the seal tape is strong:

(1) The orifice plate is made thicker, and (2) The orifice plate is fixed more tightly.

However, a larger thickness of the orifice plate causes problems in design such as decrease of the area of the ejection outlet owing to the taper formed in boring of the orifice, which decreases the ink ejection volume. Further, for sure fixing of the orifice, the head has to be made larger, which raises the cost of the production.

SUMMARY OF THE INVENTION

An object of the present invention is to provide a recording head which is free from ink leakage and from which a seal tape is readily peelable.

Another object of the present invention is to provide a recording head which can be stored stably for a long term, and is instantly usable without an adverse effect of a residual solvent or adhesive of the seal tape.

The present invention provides an ink-jet recording head having ejection outlets formed by treating a face of a plate for the ejection outlets with a water-repellent and irradiating the plate with a laser beam from the backside of the face having been treated with the water-repellent, and provided with a sealing member for sealing the ejection outlets, said water-repellent having a hardness of higher than the pencil hardness 6B at room temperature, and a second layer being formed on the layer of the water repellent in peripheral portions of the ejection outlets.

DESCRIPTION OF THE PREFERRED EMBODIMENT

Figure 1A:
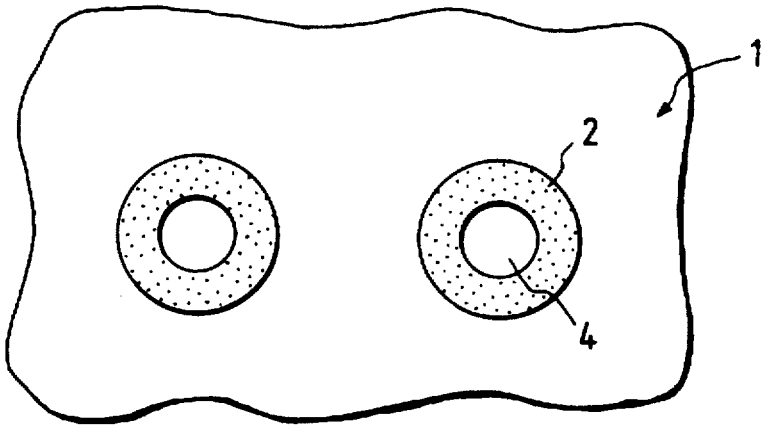
FIG. 1A and FIG. 1B illustrate the state of the face relating to the present invention.

In a preferred embodiment, the present invention enables satisfactory prevention of ink leakage independently of environmental conditions. That is, an ink container portion of a recording head having at least an air communication device is provided with a means for covering the air communication device via a pressure-sensitive adhesive and for adjusting the variation of pressure in the ink container portion. In this embodiment, the recording head is kept in a stable state in any environmental conditions by the pressure-adjusting means fixed tightly to the recording head by use of the pressure-sensitive adhesive. When the pressure adjusting means is removed from the recording head, the air communication device can surely be restored to a desired state by the peeling property of the pressure-sensitive adhesive. Particularly remarkable effects are attained when a seal tape having such a pressure-sensitive adhesive is applied not only to the air communication device but also to the ejection portion of the recording head.

The pressure-sensitive adhesive preferably contains, as the adhesive component, an acrylate ester copolymer crosslinked by an isocyanate, the acrylate ester copolymer being derived from at least 80% by weight in total of an alkyl and/or alkoxyalkyl acrylate containing a hydroxy group, and an acrylate ester having a side chain of an alkyl or alkoxyalkyl group of 4 to 9 carbons.

Preferably, the pressure-adjusting means closes tightly the ink container when the internal pressure is normal, but brings the internal pressure near to the external pressure when the internal pressure becomes abnormally high. An example is a member or a mechanism which has a normal volume (being in a shrinked state) and increases the internal volume with a rise in the internal pressure so as to cancel the increase of the internal pressure while maintaining the closed state. Another example is a member or a mechanism which forms temporarily a communication portion to communicate with the external atmosphere in response to the rise of the internal pressure to some degree to exclude the abnormal state of the pressure. In the latter example, it has been found that the internal pressure can practically be maintained stably if the communication portion to be formed temporarily has an area of 0.005 $mm^2$ or more but is smaller than the opening area of the air-communication device. In usual transportation of the recording heads, an area of not more than 0.1 $mm^2$ thereof causes no problem. The area is preferably not more than 0.05 $mm^2$ to prevent ink leakage as a result of extreme tossing during transportation.

In a particularly preferred embodiment, the ink cartridge comprises an ink container portion which has a pressure absorber to form a negative pressure by absorbing ink, an opening portion for communicating the interior of the ink container portion to an exterior atmosphere, an ink-ejection portion enclosed in the container portion, and an electrothermal transducer for generating thermal energy for causing film boiling of the ink in accordance with electric signals. The ink cartridge having a sealing member provided at the opening portion which comprises a bonding portion with an adhesive to cover the opening, a pressure-adjusting portion to control the pressure variation in the container portion, and a closing portion to close tightly the ink-ejecting portion. The adhesive component of the adhesive is an acrylate copolymer being composed of at least 80% by weight in total of an alkyl and/or alkoxyalkyl acrylate containing a hydroxy group, and an acrylate ester having a side chain of an alkyl or alkoxyalkyl group of 4 to 9 carbons. The ink-jet cartridge is made ready for use by separating the sealing member including the adjusting portion to release the opening portion and removing the sealing member from the recording head to expose the ejection portion. This method prevents ink scattering on removal of the sealing member even when the sealing member is peeled quickly.

The above preferred pressure-sensitive adhesive is of an acrylic resin type, the novel adhesive having been obtained after comprehensive investigation for achieving the above objects, and particularly for use for ink-jet recording head.

The acrylic monomer for the pressure-sensitive acrylic material includes alkyl ester monomers such as methyl acrylate, ethyl acrylate, propyl acrylate, isopropyl acrylate, butyl acrylate, isobutyl acrylate, 2-methylbutyl acrylate, 2-ethylbutyl acrylate, 3-methylbutyl acrylate, 1,3-dimethylbutyl acrylate, pentyl acrylate, 3-pentyl acrylate, hexyl acrylate, 2-ethylhexyl acrylate, heptyl acrylate, 2-heptyl acrylate, octyl acrylate, 2-octyl acrylate, nonyl acrylate, and the like, and alkoxyalkyl ester monomers such as 2-ethoxyethyl acrylate, 3-ethoxypropyl acrylate, 2-ethoxybutyl acrylate, 3-methoxybutyl acrylate, 2-ethoxyethyl acrylate, 3-methoxypropyl acrylate, and the like. Such a monomer is used in combination with the hydroxy-group-containing monomer, discussed below, in a total amount ranging from 50 to 100% by weight, preferably from 50 to 80% by weight.

The polyvalent isocyanate compound includes tolylene diisocyanate, hexamethylene diisocyanate, diphenylmethane diisocyanate, isophorone diisocyanate, xylylene diisocyanate, bis(isocyanatomethyl)-cyclohexane, dicyclohexylmethane diisocyanate, lysine diisocyanate, trimethylhexamethylene diisocyanate, adducts of tolylene diisocyanate with hexamethylene diisocyanate, urethane-modified compounds, allophanate-modified compounds, biuret-modified compounds, isocyanurate-modified compounds, urethane prepolymers (oligomeric compounds having an isocyanate group at each end), and the like.

The cohesion property of the pressure-sensitive adhesives can be adjusted by various methods.

A first method of adjusting the cohesion property of the pressure-sensitive adhesive is copolymerization with a hydroxy-group-containing monomer and crosslinking by use of a polyvalent isocyanate compound. The hydroxy-group-containing monomer includes 2-hydroxyethyl acrylate, 2-hydroxypropyl acrylate, hydroxybutyl acrylate, 2-hydroxyethyl methacrylate, 2-hydroxypropyl methacrylate, hydroxybutyl methacrylate, acrylate esters of polyhydric alcohol, methacrylate ester of polyhydric alcohol, an acrylate ester of ethylcarbitol, an acrylate ester of methyltriglycol, 2-hydroxyethyl acryloylphosphate, propoxyethyl acrylate, and so forth. The hydroxy-group-containing monomer is used preferably in an amount ranging from 5 to 25% by weight, and a part or the whole thereof is crosslinked by polyvalent isocyanate.

A second method of adjusting the cohesion property of the pressure-sensitive adhesive is appropriate use of copolymerization component such as a methacrylate monomer, vinyl acetate, styrene, acrylonitrile, acrylamide, and methacrylamide. From among the components, acrylonitrile, acrylamide, and methacryamide are particularly suitable for the ink-jet recording head of the present invention. Such a component is preferably used in an amount ranging from 5 to 15% by weight.

A third method of adjusting the cohesion property of the pressure-sensitive adhesive is crosslinking with a crosslinking monomer such as N-methylolacrylamide, N-methylolmethacrylamide, diacetonacrylamide, and butoxymethylacrylamide. The crosslinking monomer is preferably used in an amount ranging from 5 to 15% by weight.

For a more suitable pressure-sensitive adhesive, the first method of the adjustment is employed preferably in combination with the second or the third method.

The seal tape having the above acrylic type adhesive is capable of maintaining stably a fine opening corresponding to the air communication opening. In the case where the fine opening is formed on the seal tape after sealing the air communication opening by use of a needling or a punching, the seal tape is never peeled by this opening formation operation.

The alkyl acrylate ester and/or the alkoxyalkyl acrylate ester which contains the one having a short side chain of four carbons or less in an amount of 90% by weight or more has a high Tg, which may cause leakage of ink due to low adhesion strength to the nozzle surface, or partial peeling of the seal tape on forming the fine opening on the air communication opening. Otherwise, the alkyl acrylate ester and/or the alkoxyalkyl acrylate ester which contains the one having a side chain of nine carbons or more in an amount of 90% by weight or more has a low Tg, exhibits high adhesion strength, and adheres excessively tightly to the nozzle surface, causing separation of the adhesive from the supporting material thereof and soiling the nozzle surface.

The aforementioned pressure-sensitive adhesive preferably has chemical resistance to the ink-jet ink, gives less elution of an organic matter, contains less amount of polyvalent metal, and satisfactorily protects the surface of the ink-jet head. To obtain such properties, the pressure-sensitive adhesive may be prepared as below with the aforementioned materials. (1) In one method, the aforementioned monomers are solution-polymerized in an organic solvent such as a ketone, an ester, and an aromatic solvent to prepare a high polymer having a weight-average molecular weight of from 250,000 to 700,000. In the polymerization, it is important that the polymer does not contain a low polymer having a molecular weight of less than 10,000, nor a remaining monomer. Therefore, the polymerization is controlled and the low polymer is removed. The removal of the low polymer is conducted most surely by precipitation of the polymer. The precipitated polymer is dissolved again. (2) In another method, the aforementioned monomer is polymerized by emulsion polymerization using an emulsifier or soap-free emulsion polymerization to obtain a high polymer having a weight-average molecular weight of from 250,000 to 1,000,000. The polymer obtained by the emulsion polymerization is preferably treated for removal of an unpolymerized monomer and a low polymer having a molecular weight of lower than 10,000 by dissolving again in a good solvent such as xylene and ethyl acetate. To the polymer prepared by either method (1) or (2), a diisocyanate is added to provide a coating solution. This coating solution containing the diisocyanate is applied onto a supporting film in a thickness of from 5 μm to 100 μm, preferably from 5 μm to 50 μm, and is dried by means of a conventional drier. The drying conditions are depend on the kind of solvent. Usually the drying temperature being in the range of from 60° C. to 150° C. Preferably the heat-dried film is aged at room temperature for three to ten days.

In the case where the polymer as the pressure-sensitive adhesive component is derived from the alkyl. acrylate ester and/or the alkoxyalkyl acrylate ester which has an OH group and has a side chain of an alkyl group or alkoxyalkyl group of 4 to 9 carbons, and is crosslinked by an isocyanate, the pressure-sensitive adhesive is capable of surely preventing leakage of ink from the ink-ejecting outlets and retaining the fine opening corresponding to the air communication opening. In this case, during formation of the fine opening, by needling or punching after the air communication opening is sealed with a seal tape, the seal tape will not peel off. Furthermore when a user peels the seal tape forcibly in order to use the ink-jet head, the adhesive will not cause cohesion failure and the tape will not remain on the ejection outlet surface. Thus instant use of the ink-jet head and high-quality of recording is permitted.

In particular, when the acrylic polymer in the adhesive component contains butyl acrylate at a content of not less than 70% by weight, the deterioration of the seal tape and the migration of the component thereof into the ink can be avoided and peelability of the seal tape from the recording head is satisfactory. In the construction of the recording head described later, a resin or glass is frequently employed in addition to the silicon substrate. The present invention is not affected by the difference therebetween in peeling characteristic and the adhesive does not remain on the surface of the ejection outlets by cohesive failure, therefore being not limited in its use.

The acrylic polymer prepared by polymerizing an alkyl acrylate ester and/or an alkoxyalkyl acrylate ester and crosslinking it with an isocyanate into the pressure-sensitive adhesive is preferably contained in an amount of 90% by weight or more in the adhesive since such adhesive does not deteriorate on contact with ink and does not cause migration of the component thereof into the ink, producing no clogging or unstable ejection during use of the printer.

The material of the film used as the support of the pressure-sensitive adhesive of the present invention includes polyethylene terephthalate, polypropylene, polyethylene, poly-4-methylpentene-1, polyvinyl chloride, vinylidene chloride-vinyl chloride copolymers, polyvinyl fluoride, polyvinylidene fluoride, tetrafluoroethyene-ethylene copolymers, tetrafluoroethylene-hexafluoropropylene-perfluoroalkyl vinyl ether copolymers, and the like. The film may be subjected to a surface treatment such as corona discharge treatment, flame treatment, and plasma treatment for improvement of bonding of the pressure-sensitive adhesive thereon. The thickness of the supporting material in the present invention is preferably in the range of from 20 to 50 μm, more preferably from 25 to 35 μm.

In addition to the above requirements, overall stability of the sealing is attained when the peel strength of the seal tape from stainless steel (SUS 304) is adjusted to be in the range of from 200 g/25 mm to 1,200 g/25 mm. Therefore, this is one of the favorable conditions. Under this condition, peeling of the pressure-sensitive adhesive tape from the air communication opening does not occur upon forming a fine opening in the air communication opening.

Herein, the peel strength is measured at a stress rate of 300 mm/min by means of a tester specified in JIS-B-7721 having a capacity of 2.0 Kg by use of a SUS304 plate as the base plate at 180° peeling at 25° C. The thickness of the pressure-sensitive adhesive layer is closely related to the peel strength, the thickness at the peel strength measurement being preferably in the range of from 5 to 70 μm, more preferably from 20 to 50 μm. The seal tape is preferred which does not leave the adhesive even at a large thickness of the adhesive layer.

The pressure-sensitive adhesive mentioned above is effective also to the nozzle surface treated for ink repellency, retaining satisfactory adhesiveness without deterioration of the tape and nozzle surface.

The aforementioned "surface treated for ink repellency" means a surface having been treated with a treating agent such as a silicone oil, a fluorine-containing low molecular or high molecular compound, specifically including KP-801 (trade name, made by Shin-Etsu Silicone K.K.), Defennser (trade name, made by Dainippon Ink and Chemicals, Inc.), CTX-105 and -805 (trade name, made by Asahi Glass Co., Ltd.), Teflon AF (trade name, made by DuPont Co.), and so forth. The fine opening provided on a seal tape on the air communication opening has most suitably a cross-sectional area of not more than 0.05 $mm^2$ Naturally, the fine opening is not limited to be single, but may be provided in a plural number, or may be a slit-shaped cut. The fine opening may be provided by needling, or laser beam projection, but is not limited thereto.

FIGS. 2 to 6 are shown to explain each of a ink-jet unit IJU, an ink-jet head IJH, an ink tank IT, an ink-jet cartridge IJC, a main body of an ink-jet recording apparatus IJRA, and a carriage HC, and the mutual relations thereof. The constitution of the respective parts is described below by reference to these drawings.

Figure 2:
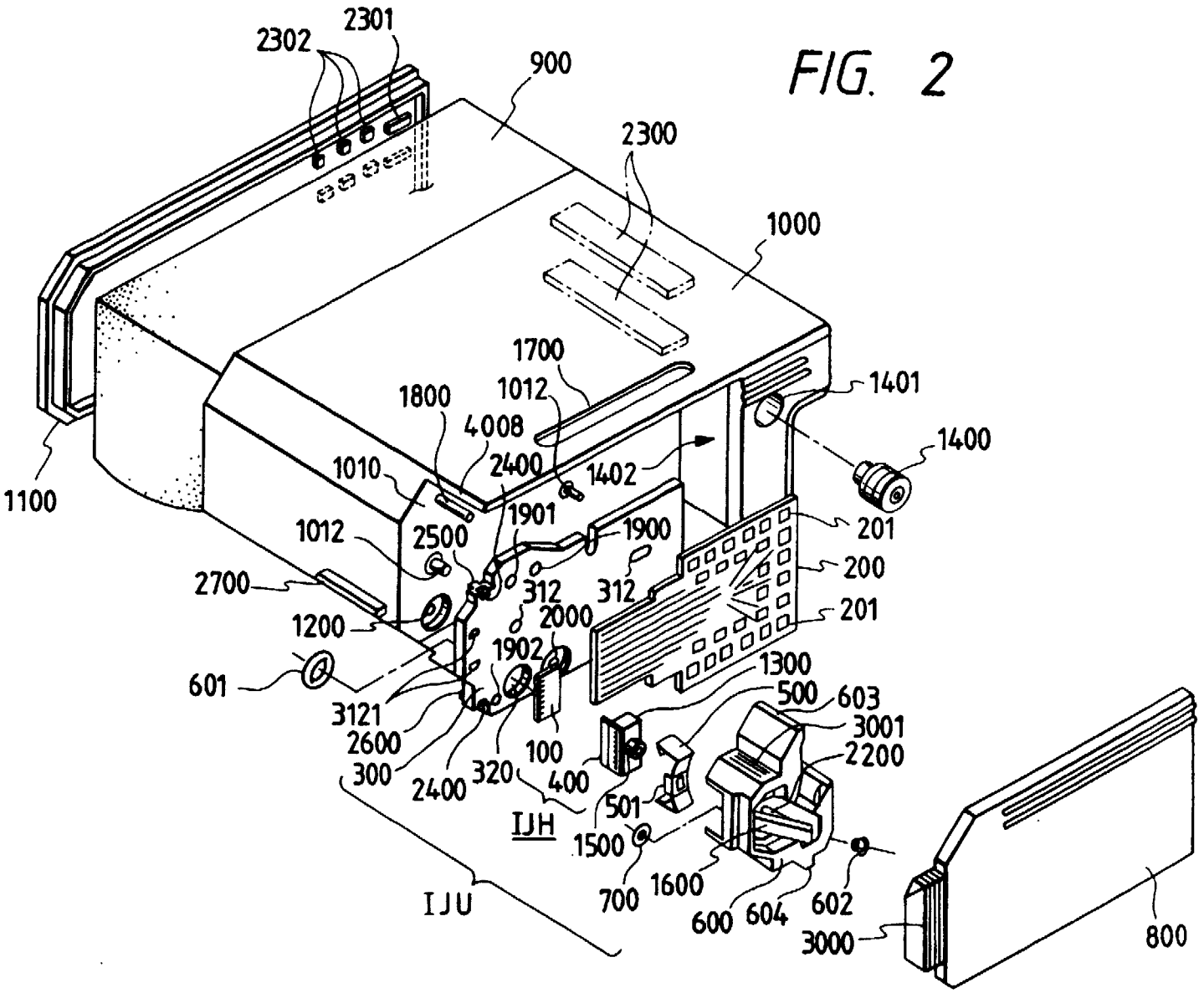
FIG. 2 is a perspective exploded view of an ink-jet cartridge of the present invention.
Figure 3:
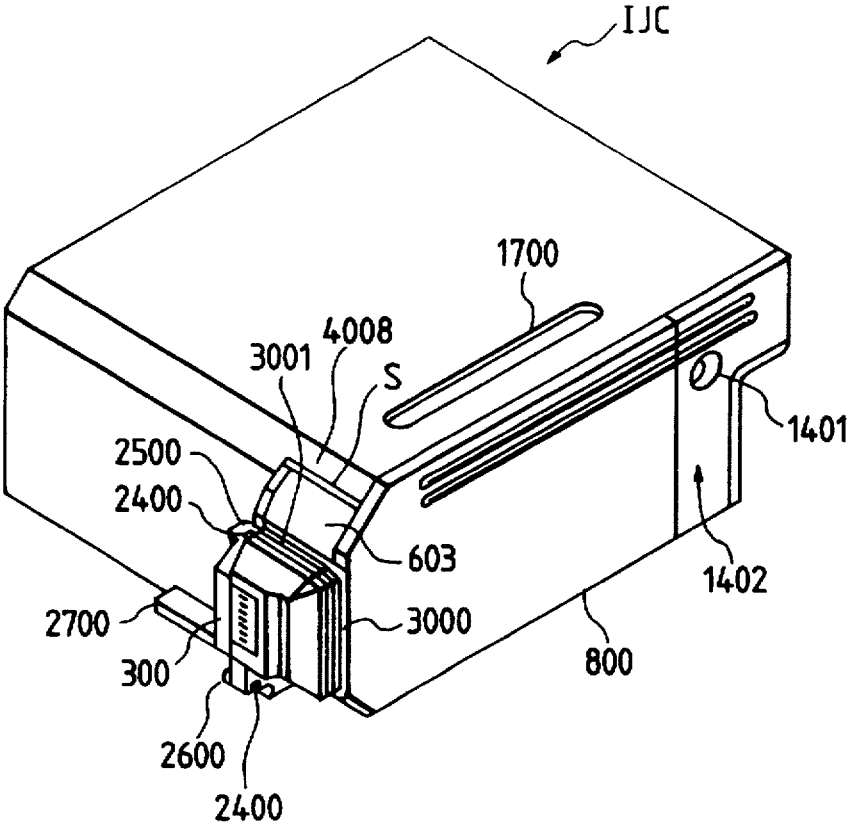
FIG. 3 is a perspective view of an assembled ink-jet recording head.

The ink-jet cartridge IJC of the example holds a larger volume of ink as shown in the perspective view of FIG. 3. The tip portion of the ink-jet unit IJU protrudes slightly from the front face of the ink tank IT. This ink-jet cartridge IJC is held and supported by, the positioning means and the electric contact point mentioned later of the carriage HC (FIG. 5) mounted on the main body of an ink-jet recording apparatus IJRA, and is detachable from the carriage HC and is disposable. FIGS. 2 to 6 illustrate various novel techniques established in the development of the present invention. The whole apparatus is described by briefly explaining the constitution of the respective drawings.

(i) Construction of Ink-Jet Unit (IJU):

The ink-jet unit IJU is a unit for recording by a bubble jet method employing thermal energy generated by a electrothermal transducer to cause film boiling of ink in accordance with electric signals.

In FIG. 2, the heater board 100 is formed by a film forming method and comprises an Si substrate, and electrothermal transducers (ejection heaters) arranged in lines on the substrate, and electric wiring for supplying electric power to the transducer. The wiring substrate 200 has a wiring for the wiring of the heater board 100 (connected, for example, by wire-bonding) and pads 201 for receiving electrical signals from the main apparatus placed at the end of the wiring.

The grooved cover plate 1300 has separators for separating the plurality of ink flow paths and common liquid chamber for holding ink for supplying the ink to ink flow paths, and is integrally formed with an ink inlet 1500 for introducing ink from the ink tank IT to the common liquid chamber and an orifice plate 400 having a plurality of ejection outlets corresponding to the ink flow paths. The material therefor is preferably a polysulfone resin. Other molding resins may also applicable.

Figure 5:
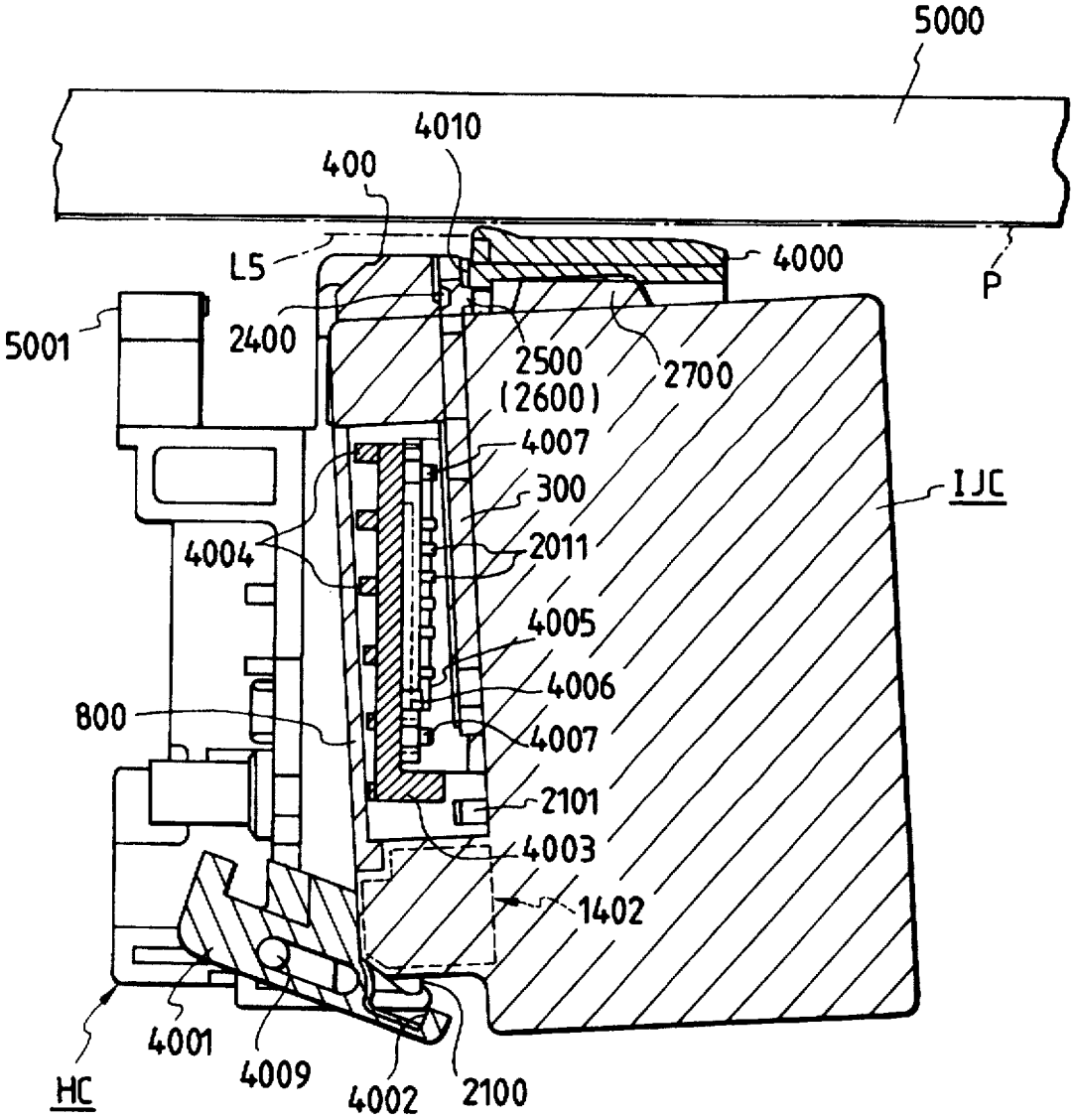
FIG. 5 is a plan view of the portion where an ink-jet cartridge is to be fitted.

A support 300 made of a metal or the like supports the wiring base board 200 at the back side, and serves as the bottom plate of the ink-jet unit. The presser bar spring 500 in an M-shape presses the common liquid chamber at a low pressure with the center portion of the M-shape. The apron portion 501 presses concentratedly a portion of the liquid paths, preferably the region around the ejection outlets with a line pressure. The heater board 100 and the cover plate 1300 are engaged between the presser bar spring 500 and the support 300 with the foot portion of the presser bar spring engaged with the back side of the support 300 through the holes 3121, and thereby press-fixed with each other by the concentrated force of the presser bar spring 500 and the apron portion 501 thereof. The support 300 has holes 312, 1900, 2000 corresponding to the two positioning projections 1012 of the ink tank IT, and positioning and heat-fusion-holding projections, 1800 and 1801, and further has positioning projections 2500 and 2600 at the back side corresponding to the carriage HC of the main apparatus IJRA. The support 300 further has a hole 320 through which an ink-supplying tube 2200 (described later) from the ink tank passes. Onto the support 300, wiring base plate 200 is bonded by use of an adhesive or the like. The hollow portions 2400, 2400 of the support 300 are respectively made in the vicinity (backside) of the projections 2500, 2600. Therefore, in the assembled ink-Jet cartridge IJC (FIG. 3), they are on extension lines of parallel grooves 3000, 3001, in surrounding three sides of the tip region of the head, thereby preventing the movement of an undesired matter, such as dust, and ink from reaching the projections 2500, 2600 along the parallel grooves 3000, 3001. The cover member 800 having parallel grooves 3000 forms the external wall of the ink cartridge IJC, and also forms a space with the ink tank for holding the ink-jet unit IJU as shown in FIG. 5. In the ink-supplying member 600 having parallel grooves 3001 formed thereon, the ink introducing tube 1600 connected to the ink supplying tube 2200 is fixed in the form of a cantilever at the side of ink supplying tube 2200. In order to ensure a capillary phenomenon between the fixed side of the ink-introducing tube and the ink-feeding tube 2200, a sealing pin 602 is inserted therein. A packing 601 is employed for connection of the ink tank IT with the ink supplying tube 2200. A filter 700 is provided at the end portion of the ink supplying tube 2200 at the side end of the ink tank.

Since the ink-supplying means 600 is prepared by mold-forming, it is inexpensive and is positionally precise, and the production accuracy is maintained high. Owing to the cantilever structure of the ink-introducing tube 1600, the pressure-contact of the ink-introducing tube with the ink inlet 1500 is kept stable even in mass production. In this example, the communication state is ensured simply by flowing a sealing adhesive from the side of the ink-supplying member under the pressure contact state. The ink-supplying member 600 is readily fixed to the support 300 in such a manner that two pins (not shown in the drawing) at the back side of the ink-supplying member 600 are projected through the holes 1901, 1902 on the support 300 respectively and fusion-bonded. The small projections formed by fusion bonding are accommodated by hollows (not shown in the drawing) on the lateral side of the ink tank IT on which the ink-jet unit IJU is attached, so that the ink-jet unit IJU is positioned precisely.

(ii) Construction of Ink Tank IT

The ink tank is comprised of the main body of the cartridge 1000, the ink absorbing body 900, and the cover member 1100, and is formed by inserting the ink-absorbing body 900 into the main body of the cartridge 1000 from the side opposite to the ink-jet unit IT, and subsequently sealing it with the cover member 1100.

The ink-absorbing body 900 is employed for holding the ink by impregnation, and is placed in the main body of the cartridge 1000. The ink supply inlet 1200 is provided to supply ink to the ink-jet unit IJU, and also serves, before assembling the unit with the portion 1010 of the main body of the ink-jet cartridge 1000, as an ink supply inlet for filling ink into the ink-absorbing body 900.

In this example, the ink can be supplied either through the air communication hole or through this supply inlet. For supplying ink satisfactorily from the ink-absorbing body, a continuous air space is formed by the ribs 2300 in the main body of the cartridge 1000 and the partial ribs 2302, 2301 of the cover member 1100 in the region from the air communication hole 1401 to the corner portion most distant from the ink supply inlet 1200. Therefore, ink is supplied relatively satisfactorily from the ink supply inlet 1200 to the ink absorbing body 900, which is important. This method is extremely effective in practice. The four ribs 2300 are provided on the back face of the main body of the ink tank 1000 in a direction parallel to the moving direction of the carriage to prevent the close contact of the ink-absorbing body 900 with the back face. The partial ribs 2302, 2301 are placed at the positions on extension lines of the ribs 2300 respectively and on the inside face of the cover member 1100, and are in a divided state different from that of the ribs 2300, so that the air space is enlarged in comparison with the former. The partial ribs 2302, 2301 are distributed in the area not more than half of the area of the cover member 1100. The ribs make it possible to introduce the ink by capillary force to the ink supply outlet 1200 from the farthest corner portion. Through an air communication hole 1401 on the cover member, the interior of the cartridge communicates with the external air. A liquid repelling member 1400 is provided inside the air communication hole 1401 to prevent ink leakage from the air communication hole 1400.

The aforementioned constitution and the arrangement of the ribs are particularly effective for the above ink tank IT, since the ink holding space thereof is in a form of a rectangular solid having its long side on the side face. In the case where the ink tank IT is in a form of a rectangular solid having its long side along the direction of moving direction of the carriage or is in a form of a cube, the ink supply from the ink-absorbing body 900 can be stabilized by providing the ribs over the whole face of the cover member 1100. The rectangular solid form is suitable for holding as much ink as possible in a limited amount of space. In order to use the stored ink effectively for recording without loss, the ribs playing the above role are preferably provided on two face regions neighboring the corner portion. Further, the inside ribs of the ink tank IT in this example are distributed uniformly in the thickness direction of the ink-absorbing body in a rectangular solid form. This constitution is important in enabling maximum utilization of substantially all the ink in the ink-absorbing body by uniformizing the atmospheric pressure distribution. The distribution of the ribs is based on the technical idea below. When the position of the ink supply inlet 1200 is projected onto the rectangular upper face of the rectangular solid and a circle is drawn with the projected position as a center with a radius of the length of the long side of the rectangle, it is important to provide the ribs at the area outside the circle line in order to give early the atmospheric pressure state. In this case, the position of the air hole of the ink tank is not limited to that in this example provided that the air is introduced to the rib-distributed region.

Further, in this example, the back side of the ink-jet cartridge IJC opposite to the head is made planar to minimize the necessary space when incorporated in the apparatus and to maximize the quantity of the ink held therein, whereby the apparatus can be miniaturized and the frequency of cartridge exchange is decreased desirably. Behind the space for integrating the ink-jet unit IJU, a projection portion of the air communication hole 1401 is formed and the inside of the projected portion is made vacant to form an atmospheric pressure supplying space 1402 over the entire thickness of the ink-absorbing body 900. Such an arrangement produce an excellent cartridge which has not ever been met. This atmospheric pressure supplying space 1402 is much larger than conventional ones, and the air communication hole 1401 is placed at a higher position. Therefore, if the ink come off from the ink-absorbing body, this atmospheric pressure supplying space 1402 is capable of retaining the ink temporarily, enabling steady recovery of the ink to the ink-absorbing body, thus providing an efficient and excellent cartridge.

Figure 4:
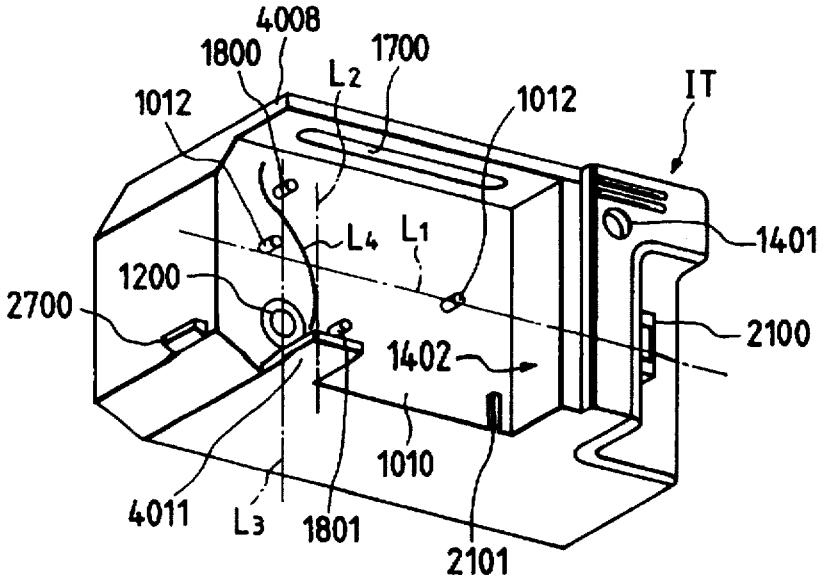
FIG. 4 is a perspective view of an ink tank of the ink-jet cartridge viewed from the side to be fitted to an ink-jet head.

The constitution of the face of the ink tank IT on which the ink-jet unit IJU is fitted is shown in FIG. 4. Two projections 1012 for positioning engaging with the holes 312 on the support 300 is on a straight line $L_1$ which passes near the center of the ejection outlet of the orifice plate 400 and is parallel to the bottom face of the ink tank IT or a base face of the mounting of the carriage. The projection 1012 has a height slightly less than the thickness of the support 300, and positions the support 300. On the extension line of $L_1$ in this drawing, a claw 2100 is provided which engages with an engaging face 4002 perpendicular to the hook 4001 for positioning the carriage 16. Thus the force for positioning the carriage 16 exerts in the a planar region parallel to the base face containing the line $L_1$. As mentioned later by reference to FIG. 5, such construction relation is effective since the accuracy of positioning of the ink tank itself is nearly equal to the accuracy of the positional positioning of the ejection outlet of the head.

The projections 1800, 1801 of the ink tank 14 corresponding respectively to the holes 1900, 2000 on the support 300 for fixing it to the side face of the ink tank are longer than the aforementioned projection 1012, and are utilized for fixing the support 300 by bonding by fusion of the portion projecting through the support 300. On a line $L_3$ perpendicular to the above-mentioned line $L_1$ and passing the projection 1800, approximate center of the ink supply inlet 1200 is placed. Thereby the bonding of the ink supply inlet 1200 with the ink supply tube 2200 is stabilized, and a load caused by dropping or impact exerted to the bonding portion is reduced preferably. The line $L_2$ passes the projection 1801. The lines $L_2$, and $L_3$ are not coincident with each other. The projections 1800, 1801, around the projection 1012 at the ejection outlet side of the head IJH, also serve for positioning the head IJH relative to the tank. The curve $L_4$ denotes position of the outside wall when the ink supplying member 600 is mounted. The projections 1800, 1801 are arranged along the curve $L_4$, which give sufficient strength and positional precision against the weight of the construction of tip portion of the head IJH. The tip collar 2700 of the ink tank IT is inserted to the hole of the front plate 4000 of the carriage, to meet abnormality such as extreme displacement of the ink tank. The stopper 2101 against slipping from the carriage 16 is provided to fit a bar (not shown in the drawing) of the carriage HC, and is a protecting member for maintaining the mounted state when the cartridge IJC comes under the bar as described later at the position where cartridge IJC had been mounted and receives a vertical force to displace it from the determined position.

The unit IJU is fitted up to the ink tank IT, and then covered with the cover member 800 to enclose the unit IJU except the bottom opening portion. In the ink-jet cartridge IJC, however, the bottom opening for mounting on the carriage HC comes close to the carriage HC, substantially forming a four-side-enclosed space. Although the enclosed space serves effectively for thermal insulation for heat generated by the head IJH, slight temperature elevation will occur after a long period of operation. As the countermeasure thereto in this example, a slit 1700 is provided which has a smaller width than the enclosed space to prevent temperature elevation and simultaneously make the temperature distribution throughout the the entire unit IJU uniform, independent of the environment.

After the ink-jet cartridge IJC is assembled, the ink is supplied to the ink supplying tank 600 from the interior of the cartridge through the ink supply inlet 1200, the hole 320 on the support 300, and an introducing opening at the back side of the ink supplying tank 600, and then flows into the common liquid chamber through an outlet hole, a suitable supply tube, and the ink inlet 1500 on the cover plate 1300. The ink supply path is ensured by sealing the connecting portion of the ink path with packings made of silicone rubber, butyl rubber or the like.

In this example, the cover plate 1300 is made of an ink-resistant resin such as polysulfone, polyether sulfone, polyphenylene oxide, and polypropylene, and is formed integrally with the orifice plate portion 400.

As described above, the ink supplying member 600, the cover plate 1300 with-the orifice plate 400, and the main body of the ink tank 1000 are respectively molded as an integrated part, which makes the assemblage precise and is effective in high-quality mass production. The number of parts is less than conventional recording heads, so that the intended superior characteristics are surely obtained.

In this example, as shown in FIGS. 2 to 4, after the head is assembled as above, the upper face 603 of the ink-supplying member 600 forms a slit S with the end 4008 of the roof having the slit 1700 of the ink tank IT as shown in FIG. 3, and the lower face 604 thereof forms a slit (not shown in the drawing) similar to the above slit S with the head side end portion 4011 of a thin plate bonded to the lower cover 800 of the ink tank IT. These slits accelerate the heat release from the aforementioned opening 1700, and will prevent any direct action of force to the ink-supplying member 600 or the ink-jet unit IJU if undesired force is given to the ink tank IT.

(iii) Fitting of Ink-Jet Cartridge IJC to Carriage HC

In FIG. 5, the platen roller 5000 guides the recording medium P (e.g., recording paper) from the back side of the plane of the drawing to the front side thereof. The carriage HC, which moves along the length direction of the platen roller 5000, is provided with a front plate 4000 (2 mm thick) in the front side of the carriage 16, namely the platen roller side, a flexible plate 4005 having pads 2011 corresponding to the pads 201 on the wiring plate 200, a supporting plate 4003 for electric connection for holding rubber pad sheet 4007 exhibiting elasticity to press the pads 2011 from the backside, and a positioning hook 4001 for fixing the ink-jet cartridge IJC at a predetermined recording position. The front plate 4000 has two projected face 4010 for positioning in correspondence with the projection 2500, 2600 of the support 300 of the cartridge, and receives a force perpendicular to the projected face 4010 after the cartridge is mounted. Therefore, a plurality of strengthening ribs (not shown in the drawing) are provided on the platen roller side of the front plate. These ribs also form head-protecting projection portions which project slightly (about 0.1 mm) from the front face position L5 of the mounted ink-jet cartridge IJC toward the platen roller. The supporting plate 4003 for electric connection has a plurality of strengthening ribs 4004 which are directed vertical to the above ribs. The projection length of these ribs decreases from the one at the platen side to the one at the hook 4001 side, whereby the cartridge is fitted obliquely as shown in the drawing. The supporting plate 4003 has a flexible sheet 4005 provided with pads 2011 corresponding to the pads 201 on the wiring base board 200 of the ink cartridge 11, and a rubber pad sheet 4007 with botches providing elasticity for pressing the flexible sheet to each of pads 2011 from the back side. For stabilizing the electric contact between the pads 201 and the pads 2011, the supporting plate 4003 has a positioning face 4006 at the hook 4001 side which exerts a force to the ink-jet cartridge in a direction reverse to the exertion direction of the above projected face 4010. Pad contact is made therebetween, and the deformation of the botches of the rubber sheet 4007 corresponding to the pads 2011 is decided definitely. When the cartridge IJC is fixed at the recording position, the positioning face is in contact with the surface of the wiring base board 200. Since the pads 201 are distributed symmetrically regarding the aforementioned line $L_1$ the rubber pad sheet 4007 having botches deformed uniformly, and the contact pressure between the pads 2011 and the pads 201 is stabilized. In this example, the distribution of the pads 201 is in two lines vertically and in two lines laterally.

The hook 4001 has a long slit for engaging with a fixing axis 4009. After counterclockwise rotational movement from the position shown in the drawing, through the space provided, the ink-jet cartridge IJC is positioned relative to the carriage HC by movement to the left along the length direction of the platen roller 5000. The movement of the hook 4001 may be made in any manner, but preferably made by a lever manipulation. In any way, in the rotational movement of the hook 4001, the cartridge IJC moves toward the platen roller side to the point where the positioning projections 2500, 2600 can come into contact with the positioning face 4010 of the front plate. By the lefthand movement of the hook 4001, with hook face 4002 at 90° being kept in close contact with the 90° face of the claw 2100 of the cartridge IJC, the cartridge IJC rotates horizontally around the contact region of the positioning face 2500 with the positioning face 4010, finally causing the contact of pads 201 with pads 2011. When the hook 4001 is to be held at the predetermined position, or a fixing position, the complete contact of the pads 201 with the pads 2011, complete facial contact of positioning face 2500 with the positioning face 4010, and facial contact of the 90° face of hook 4002 with the 90° face of the claw are realized, thus finishing the mounting of the cartridge IJC on the carriage.

(iv) Outline of Main Body of Apparatus

Figure 6:
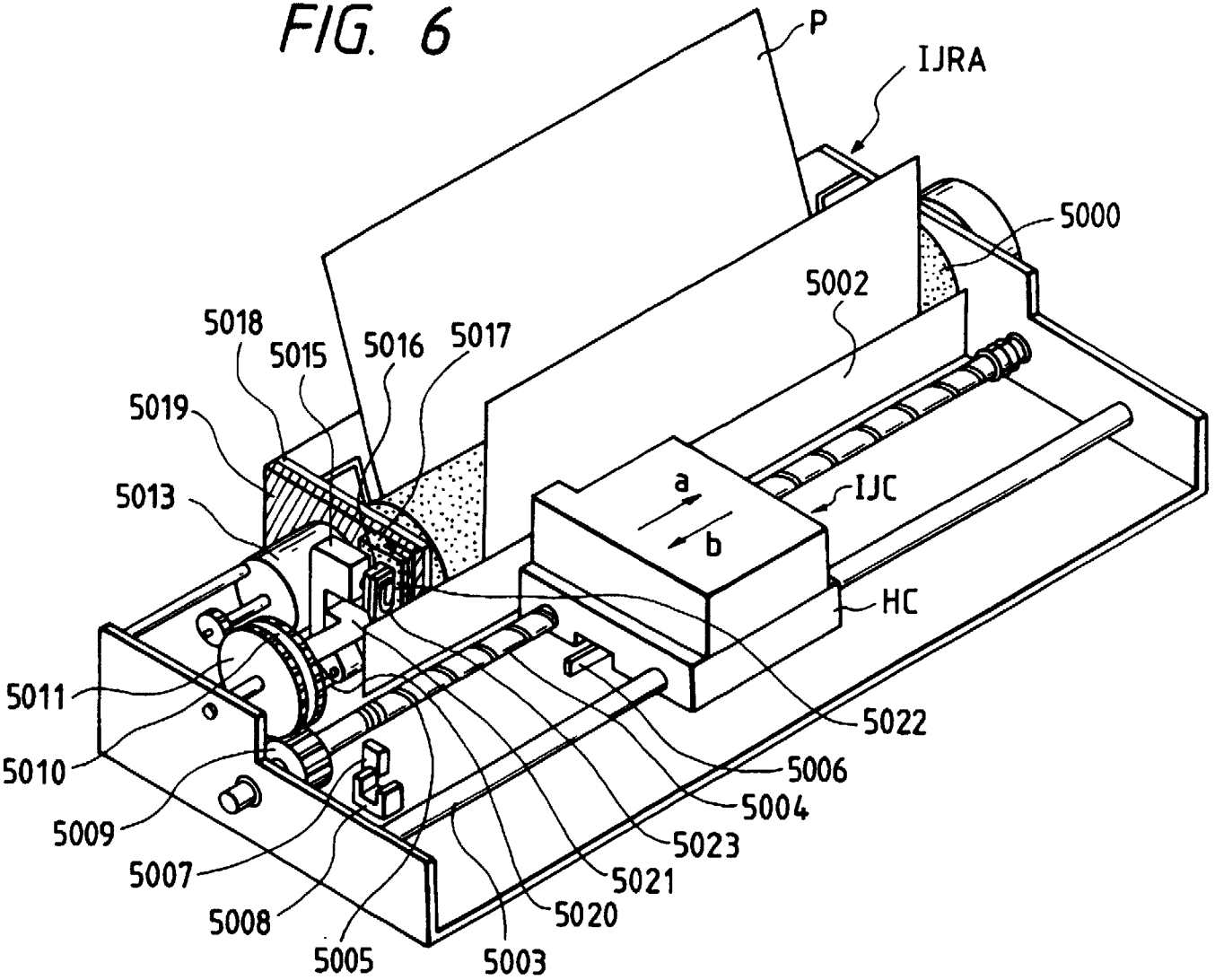
FIG. 6 is a perspective view of the main portion of an ink-jet recording apparatus provided with an ink-jet cartridge.

An ink-jet recording apparatus IJRA applicable in the present invention is shown schematically in FIG. 6. A leading screw 5005 having a spiral groove 5004 is driven to rotate in normal or reversed direction by interlocking with a driving motor 5013 through driving force-transmitting gears 5011 and 5009. The carriage HC is engaged with the spiral groove 5004 by a pin (not shown in the drawing), and is guided slidably to move in the direction shown by arrow marks a and b reciprocally. A paper-pressing plate 5002 pushes and presses a recording medium (or paper) toward the platen roller 5000 throughout the moving direction of the carriage. Photocouplers 5007, 5008 form a home-position-detecting means to confirm the position of the lever 5006 of the carriage 16 to be within the region and to control the driving direction, etc. of the motor 5013. A capping member 5022 for capping the front face of the recording head is supported by the supporting member 5016 and has a suction means 5015 for recovering the suction of the recording head through an opening 5023 in the cap. The main-body-supporting plate 5018 has a supporting plate 5019. A cleaning blade 5017 supported slidably by the supporting plate 5019 is driven forward and backward. The shape of the cleaning blade is not limited to the one shown in the drawing, but a variety of known shape of blades are applicable in the present example. The lever 5021 is provided to start the suction-recovery operation, moving with the movement of a cam 5020 engaging with the carriage. The movement is caused by the driving force of the driving motor transmitted by a known transmitting means such as a shift clutch.

The respective operations of capping, cleaning, and suction recovery are conducted at the corresponding site by action of the leading screw 5005 when the carriage comes to the home position. Any of the operations are applicable in the present invention, if the operations are conducted at a known timing and in a desired manner. The respective constructions are superior separately or combination, and are preferred in the present invention.

The present invention relating technically to the constructions shown in FIGS. 2 to 6 is explained below by reference to FIGS. 1A and 1B, and FIGS. 7 to 9.

Figure 7:
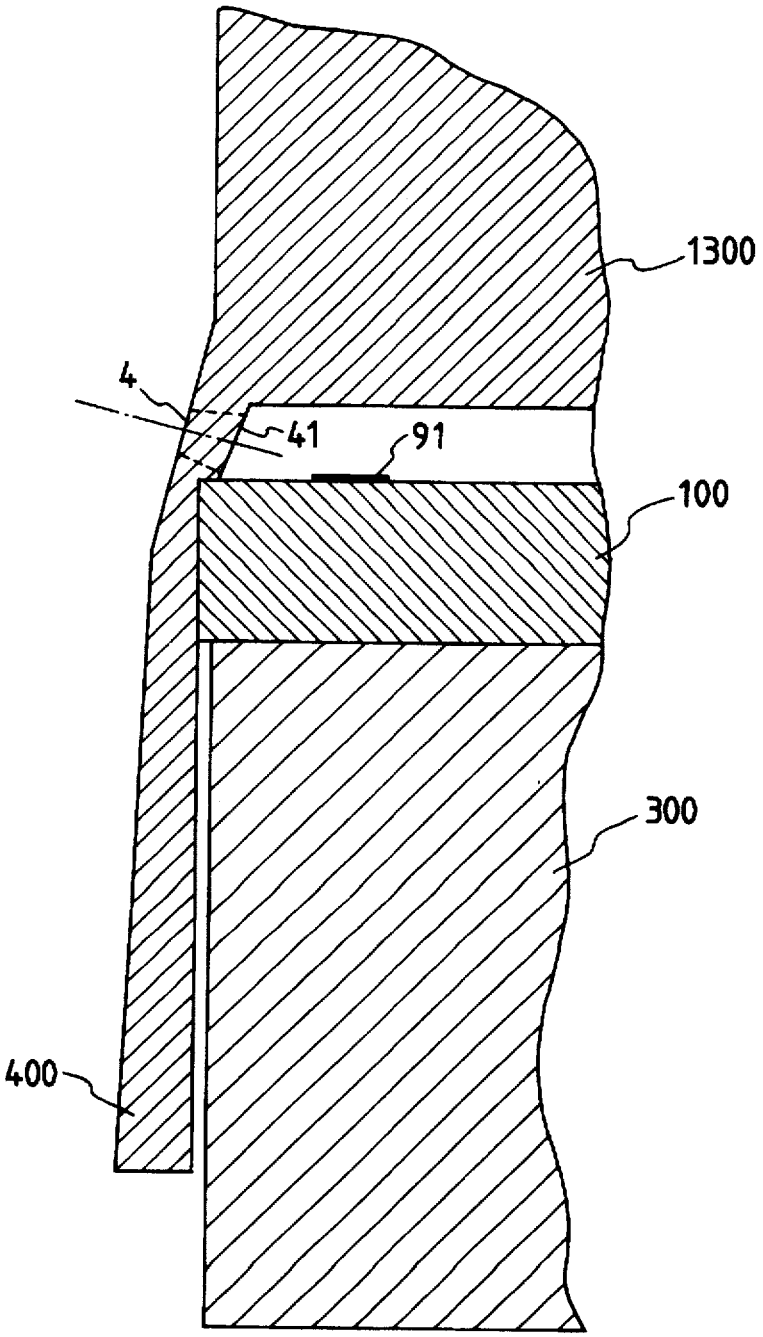
FIG. 7 is an enlarged schematic drawing illustrating the main portion of a preferable recording head.

FIG. 7 is an enlarged sectional view of the combination of an integrally molded member comprising an orifice plate 400 and a grooved cover plate 1300, and a heater board 100 shown in FIG. 2. The ejection outlets 4 are formed at the portion 41 by piercing the orifice plate with excimer laser. A heater portion 91 of an electrothermal transducer as the thermal energy generating element generates thermal energy for ejecting ink. Input of pulse signals to heaters 91 in accordance with inputted data causes bubbling of ink on the heater, and by this energy the ink is ejected from the orifices 41 in liquid droplets. The droplets shoot against a paper surface 0.5 to 1.0 mm away from the orifices 41, thus achieving recording in accordance with the inputted data.

In this example, the grooved cover plate 1300 and the orifice plate 400 placed vertically at the end of the cover plate are molded integrally by casting or a like method. A water repellent in a molten state is applied thereon to form a solid layer of the water repellent. Then a laser beam is projected to the portion 41 from the backside opposite to the ejection direction at a predetermined angle θ of from 5° to 10° to form the ejection outlet 4. The drawing shows a state before the formation of the ejection outlet.

In this arrangement, the face of the orifice plate comprises three planes forming steps in gentle slope in consideration of the strength of the orifice plate and sure cleaning by wiping.

The preferred material for the integral molding of the grooved cover plate 1300 with the orifice plate 400 includes thermoplastic resins such as polyether-ether-ketones, polyimides, polysulfones, and the like in view of the material cost and the resistance to ink. In this example, a polysulfone is used which is deformed less even at a high temperature.

Figure 1B:
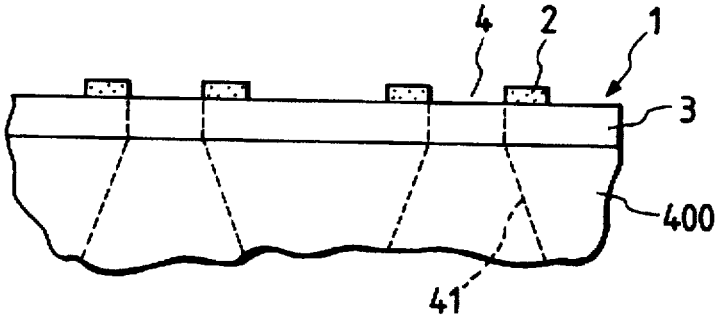

In the constitution like this example, a decomposition product is observed to be produced in the process of formation of orifice 41 by piercing with a laser, and the product was confirmed to adhere around the ejection outlet after the outlet formation. FIGS. 1A and 1B illustrate the state of the face 1 (hereinafter referred to as a "face plane") where the ejection outlets 4 are formed. FIG. 1A illustrates the orifice plate 400 viewed from the face plane side, and FIG. 1B illustrates it viewed from a lateral side. As shown in the drawings, the decomposition product 2 which is formed in the ejection outlet formation adheres in a layer formed around the ejection outlet 4 on the layer of the water repellent 3. As a result of analysis, the product 2 was determined to be a mixture of carbon and the water repellent. The formation state of the mixture was found to depend on the power of the laser and on heat treatment after the ejection outlet formation.

The product around the ejection outlet increases the adhesion strength of the seal tape there to prevent the ink leakage. Specific examples of the present invention are shown below.

Example 1

On the ejection face 1, a water repellent, Sitop (trade name, made by Asahi Glass Co., Ltd.) was applied. The orifice plate was subjected to orifice formation processing by use of excimer laser (output power: 1 J/cm$^2$ pulse) from the face opposite to the ejection face 1. After the orifice formation, the orifice plate was heat treated in an oven at 150° C. for 3 hours.

Figure 9:
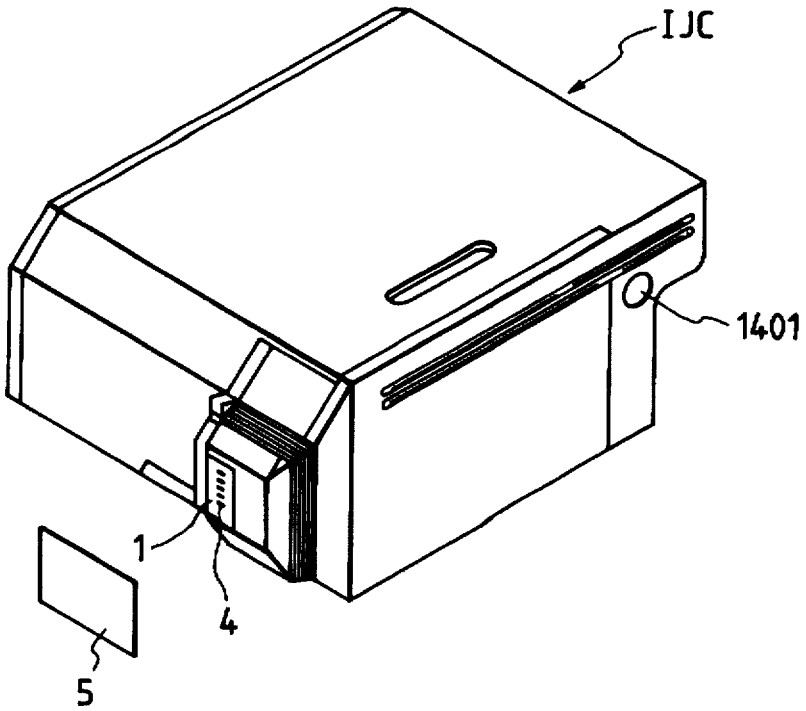
FIG. 9 is a perspective view of an ink-jet cartridge and a seal tape.

With this orifice plate 400, an ink-jet cartridge was prepared as shown in FIG. 9.

Figure 8:
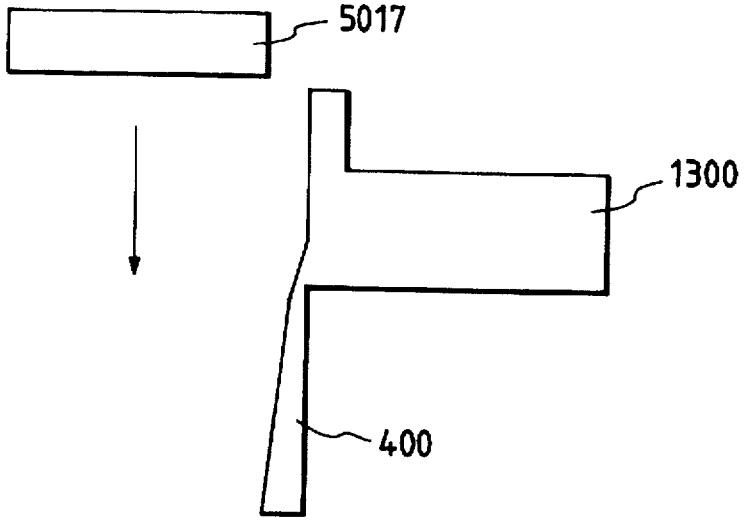
FIG. 8 is a schematic diagram illustrating cleaning of the face of an ink-jet head.

Then the ejection face was scanned with Rubisel (trade name, made by Toyo Polymer Co.) as a cleaning member 5017 in a direction shown by the arrow mark in FIG. 8 to remove ink and dust on the ejection face. Subsequently, a seal tape 5 (comprising a support made of PET (27 mm thick) and an acrylic adhesive (25 μm)) was sticked onto the ejection face.

Example 2

An ink cartridge was prepared in the same manner as in Example 1 except that Defennsa (trade name, made by Dainippon Ink and Chemicals, Inc.) was used as the water repellent.

Comparative Example 1

An ink cartridge was prepared in the same manner as in Example 1 except that Kp801 (trade name, made by Shin-Etsu Chemical Co., Ltd.) was used as the water repellent.

The effect of the present invention was evaluated by measuring the peel strength of the tape and by the minimum pressure at the air communication outlet 1401 to cause leakage of ink from the ejection outlet.

For evaluation of the effect of the present invention, comparison samples were prepared in which the water repellency treatment and the orifice formation processing were conducted in the reverse order for both the Examples and the Comparative Example (the comparative example not having the "product 2" on the ejection face).

As the results show in Table 1, ink leakage was reduced with little change of the peel strength in Examples 1 and 2, while the ink leakage was not improved in Comparative Example 1. The reason is that the water repellent Kp801 employed in Comparative Example has a hardness of not higher than the pencil hardness 6B (not measureable), and the product 2 had been removed in an ejection face cleaning step before the application of the tape. The absence of the product 2 was confirmed by observation of the ejection face.)

TABLE 1

| | Minimum pressure to cause ink leakage | Peel strength |
|---|---|---|
| Example 1 | Improved | Changed little |
| Example 2 | Improved | Changed little |
| Comparative example 1 | Not changed | Not changed |

As described above, the adhesiveness of the tape is strengthened only at the vicinity of the ejection outlet by the presence of the product adhering on the ejection face, whereby the ink leakage is prevented with little increase in the peel strength required to remove the tape.

This increases the freedom in design of the orifice plate thickness, the fixing method, and so forth, enabling developement of a new head having more desirable ejection properties, and lowering the production cost.

Furthermore, since no strong force is required to peel the tape, the inconveniences of tape peeling, such as accidental dismounting of the head and soiling by scattering of ink, can be avoided.

What is claimed is:

1. An ink jet recording head produced by the process comprising the steps of:

providing a substrate provided with an energy generating element for electing an ink;

providing a cover plate having a groove for forming a flow path by bonding the cover plate with the substrate, the groove having an end portion, and having an orifice plate provided at the end portion of the groove;

applying to a surface of the orifice plate a water-repellent having a hardness higher than a pencil hardness 6B at room temperature to form a water repellent layer;

irradiating a laser beam from a groove side to the orifice plate provided with the water repellent layer to form in the orifice plate an ejection outlet for electing the ink, communicating with the groove;

heat-hardening the water-repellent so that a decomposition product produced by the laser irradiation is fixed at a periphery of the ejection outlet in a state such that the decomposition product is mixed with the water-repellent;

bonding the substrate with the cover plate having the water repellent layer which has heat-hardened to form the flow path; and sealing a surface of the ejection outlet of the orifice plate with a sealing member.

2. A method of making an ink jet recording head, comprising the steps of:

providing a substrate provided with an energy generating element for electing an ink;

providing a cover plate having a groove for forming a flow path by bonding the cover plate with the substrate, the groove having an end portion, and having an orifice plate provided at the end portion of the groove;

applying to a surface of the orifice plate a water-repellent having a hardness higher than a pencil hardness 6B at room temperature to form a water repellent layer;

irradiating a laser beam from a groove side to the orifice plate provided with the water repellent layer to form in the orifice plate an ejection outlet for electing the ink, communicating with the groove;

heat-hardening the water-repellent so that a decomposition product produced by the laser irradiation is fixed at a periphery of the ejection outlet in a state such that the decomposition product is mixed with the water-repellent;

bonding the substrate with the cover plate having the water repellent layer which has heat-hardened to form the flow path; and sealing a surface of the ejection outlet of the orifice plate with a sealing member.

3. An ink jet recording head according to claim 1, wherein said sealing member comprises a seal tape.

4. A method of making an ink jet recording head according to claim 2, wherein said sealing member comprises a seal tape.

* * * * *

UNITED STATES PATENT AND TRADEMARK OFFICE

CERTIFICATE OF CORRECTION

PATENT NO. : 5,786,832

DATED : July 28, 1998

INVENTOR(S) : AKIHIRO YAMANAKA, ET AL.

It is certified that error appears in the above-identified patent and that said Letters Patent is hereby corrected as shown below:

On the title page, On the title page,

AT [30], FOREIGN APPLICATION PRIORITY DATA

"3-044770" should read --4-044770--;

AT [56], REFERENCES CITED

Under U.S. PATENT DOCUMENTS, insert
--5,365,255 11/1994 Inoue et al. 347--;
and --4,994,825 2/1991 Saito et al. 346--.

COLUMN 3

Line 21, "having" should read --has--.

COLUMN 5

Line 22, "depend" should read --dependent--;
Line 23, "being" should read --is-- "of" should be deleted;
Line 27, "alkyl." should read --alkyl--;
Line 40, "Thus" should read --Thus,--.

COLUMN 6

Line 24, "of" should be deleted;
Line 42, "$mm^2$" should read --$mm^2$.--;
Line 47, "a" should read --an--.

COLUMN 7

Line 20, "also" should read --also be--.

UNITED STATES PATENT AND TRADEMARK OFFICE

CERTIFICATE OF CORRECTION

PATENT NO. : 5,786,832

DATED : July 28, 1998

INVENTOR(S) : AKIHIRO YAMANAKA, ET AL.

It is certified that error appears in the above-identified patent and that said Letters Patent is hereby corrected as shown below:

COLUMN 8

Line 17, "IT" should read --IT:--.

COLUMN 9

Line 33, "produce" should read --produces--;
Line 37, "come" should read --comes--.

COLUMN 10

Line 36, "the" (second occurrence) should be deleted;
Line 53, "with-the" should read --with the--.

COLUMN 11

Line 4, "HC" should read --HC:--;
Line 55, "drawing," should read --drawing--.

COLUMN 12

Line 10, "Apparatus" should read --Apparatus:--.

COLUMN 13

Line 54, "sticked" should read --stuck--;
Line 67, "Co,." should read --Co.,--.

UNITED STATES PATENT AND TRADEMARK OFFICE

CERTIFICATE OF CORRECTION

PATENT NO. : 5,786,832

DATED : July 28, 1998

INVENTOR(S) : AKIHIRO YAMANAKA, ET AL.

It is certified that error appears in the above-identified patent and that said Letters Patent is hereby corrected as shown below:

COLUMN 14

Line 34, "required" should read --or force required--.

Signed and Sealed this

Fourth Day of May, 1999

*Attest:*

*Attesting Officer*

Q. TODD DICKINSON

*Acting Commissioner of Patents and Trademarks*